United States Patent [19]

Groth et al.

[11] 4,392,614

[45] Jul. 12, 1983

[54] PORTABLE PAINT SPRAYER

[75] Inventors: Hugh F. Groth, Brecksville; John D. Vogel, Sagamore Hills, both of Ohio

[73] Assignee: The Wooster Brush Company, Wooster, Ohio

[21] Appl. No.: 224,635

[22] Filed: Jan. 12, 1981

[51] Int. Cl.[3] ..... B05B 3/08

[52] U.S. Cl. ..... 239/215; 220/346; 239/218.5; 239/222; 239/224; 464/174; 464/179

[58] Field of Search ..... 220/300, 301, 346, 347; 464/174, 179; 239/214, 215, 218.5, 222, 223, 224, 332, 333, 700, 701–703

[56] References Cited

U.S. PATENT DOCUMENTS

| | | | |
|---|---|---|---|
| 401,881 | 4/1889 | Gare | 464/179 X |
| 1,874,397 | 8/1932 | Webb | 464/174 X |
| 2,086,921 | 7/1937 | Norris | 239/218.5 |
| 2,257,807 | 10/1941 | Morse | 239/215 |
| 3,074,650 | 1/1963 | Kanarek | 239/218.5 |
| 3,379,381 | 4/1968 | Decaux | 239/333 |
| 4,148,932 | 4/1979 | Tada et al. | 239/700 X |
| 4,235,377 | 11/1980 | Davis et al. | 239/215 |
| 4,294,408 | 10/1981 | Snyder et al. | 239/218.5 |
| 4,325,646 | 4/1982 | Sasaki | 220/346 X |

*Primary Examiner*—Andres Kashnikow

*Attorney, Agent, or Firm*—Maky, Renner, Otto & Boisselle

[57] ABSTRACT

A portable paint spraying device for generating a paint spray by centrifugally impelling liquid paint from the edge of a vertically oriented spinning disc. The disc is driven by an electric motor which also drives a conveyor screw used to lift the paint upwardly from a reservoir or container through a vertically oriented pump tube and into a spray chamber in the sprayer housing. The pump tube has a horizontal portion at the upper end thereof terminating in a delivery orifice through which the liquid paint is discharged into a centrally located recess or well in the front face of the disc. The disc has a relatively large flat annular region surrounding the central well which is in turn surrounded by an outer peripheral angled flange or lip having a feathered edge. The spray dispersion pattern is defined by a vertically oriented spray discharge slot in the pump housing, a movable shutter between the spray discharge slot and disc, and a series of baffles within the spray chamber which also assist in returning excess liquid to the paint reservoir. The amount of paint exiting from the paint sprayer may be controlled by controlling the amount of overlap between the movable shutter and spray discharge slot; also by diverting a portion of the paint which is lifted by the conveyor screw back to the reservoir instead of delivering same onto the sprayer disc.

60 Claims, 9 Drawing Figures

PORTABLE PAINT SPRAYER

CROSS-REFERENCE TO RELATED APPLICATIONS

This application relates to certain improvements in paint sprayers of the type disclosed in U.S. Pat. No. 4,235,377, dated Nov. 25, 1980.

BACKGROUND OF THE INVENTION

This invention relates to a portable paint sprayer of the airless type operative to generate a spray by centrifugally impelling liquid paint from a spinning disc.

Examples of portable airless spraying devices may be found in U.S. Pat. Nos. 3,125,296; 3,197,142; and 3,455,507 in which a horizontally oriented rotating disc is used to impel paint conveyed thereto centrifugally through a horizontal slot in the housing to provide a horizontal spray pattern. Such spray devices are of a relatively complicated construction, and fairly difficult to clean, and are not as compact and light as desired for easy hand use. Also, a horizontal spray pattern is difficult to maintain and control.

The paint sprayer disclosed in the aforementioned U.S. Pat. No. 4,235,377 eliminates many of the drawbacks of such previous known portable airless spraying devices, and the spraying device of the present invention is of the same general type but includes other features which enhance its performance and make it less expensive to manufacture and easier to use and maintain.

SUMMARY OF THE INVENTION

With the foregoing in mind, it is a principal object of this invention to provide a portable paint sprayer which is improved in the above-noted respects.

Another object is to provide such a paint spayer which is relatively simple in construction with few moving parts, and is characterized by ease of use, maintenance, and manufacture.

A further object is to provide such a paint spayer with improved spray generation.

Still another object is to provide such a paint sprayer with an adjustable spray dispersion pattern.

Another object is to provide such a paint sprayer in which the volume of paint directed onto the surface to be coated may be reduced without reducing the speed of rotation of the disc drive motor or pump driven thereby.

A further object is to provide such a paint sprayer with a more controlled vertical fan-like spray pattern for improved paint application to the surface to be coated.

Yet another object is to provide such a paint sprayer with improved interception of excess paint from the spray and return to the paint reservoir.

A further object is to provide such a paint sprayer with easy access to every component part for ease of clean up as well as maintenance and repair.

These and other objects of the present invention may be obtained by a paint sprayer including a vertically oriented spinner disc rotatably driven within a spray chamber for centrifugally impelling liquid paint from its surface to form a spray which is directed through a vertically oriented spray discharge slot in the sprayer housing. The same motor that drives the spinner disc also drives a paint conveyor screw for lifting paint upwardly from a paint reservoir through a vertically oriented pump tube into a spray chamber in the sprayer housing. The lower end of the pump tube is desirably slotted to inhibit the formation of large air bubbles at the bottom of the tube and provide additional flow paths for the paint into the tube in the event that an air bubble does form thereat.

Within the spray chamber the pump tube has a right angle bend thus providing a horizontal tube portion through which the paint is pumped for discharge through a delivery orifice into a centrally located well or recess on the front face of the disc. The disc has a relatively large flat annular region surrounding the central well and is in turn surrounded by an outer peripheral angled lip with a feathered edge. Fine radial grooves may also be provided in such feathered edge to reduce the size of the released droplets and produce finer atomization of the paint particles.

The spray dispersion pattern is defined by the shape of the spray discharge slot in the sprayer housing and various baffles which not only remove the excess liquid from the spray, but also assist in returning such excess liquid to the reservoir. A front trimmer is also desirably provided which slopes toward the spray discharge slot from one wall of the spray chamber to the other across the upper edge of the spinner disc to conduct the excess paint, which is blown forward along such one wall by the spinner disc, across the spinner disc and down along the pointed edge of the trimmer adjacent the other wall where it drips back into the paint reservoir.

A movable shutter between the spray discharge slot and spinner disc may be adjusted to vary the spray pattern as well as the amount of liquid being sprayed. In one position, the shutter will completely close off the discharge slot to shut off the spray when desired even though the disc is rotating and the pump is operating. Also, the amount of paint that is directed onto the disc may be reduced without reducing the speed of the pump as by providing one or more circumferentially spaced holes in the pump tube above the paint lifting screw which may be selectively uncovered for returning a portion of the paint being pumped directly back to the reservoir. This is particularly important in order to maintain good paint atomization over a wide range of viscosities of the liquid being pumped, in that if the volume of high viscosity liquids being pumped onto the disc is not reduced, the thicker liquid material may be spun off in large droplets, which is undesirable.

A quick-release bayonet type connection is provided between the reservoir and sprayer housing to facilitate filling of the reservoir with paint and provide for ease of clean-up of the reservoir and associated pump parts. To further aid in cleaning, the disc may also be removed from the motor bushing, allowing the entire pump assembly to be removed from the unit. The pump housing can then be disassembled for full access in cleaning of all contaminated parts.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
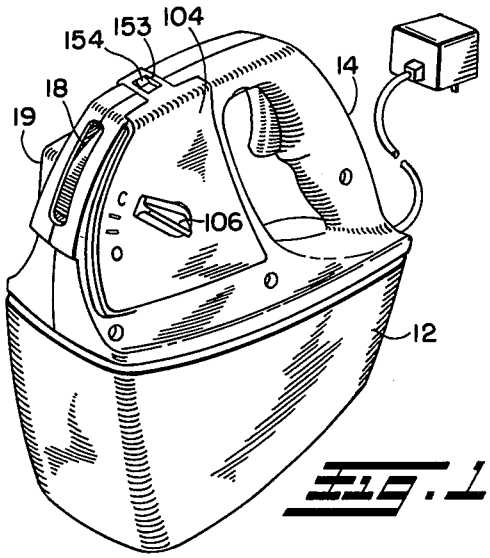
FIG. 1 is a perspective view of a preferred form of paint sprayer in accordance with the present invention.

Referring now in detail to the drawings, and initially to FIG. 1 threreof, the paint spraying device 10 of the present invention includes a sprayer housing 11 and paint reservoir or container 12 removably attached to the bottom thereof. Toward the rear of the housing is a gripping handle 14.

Figure 2:
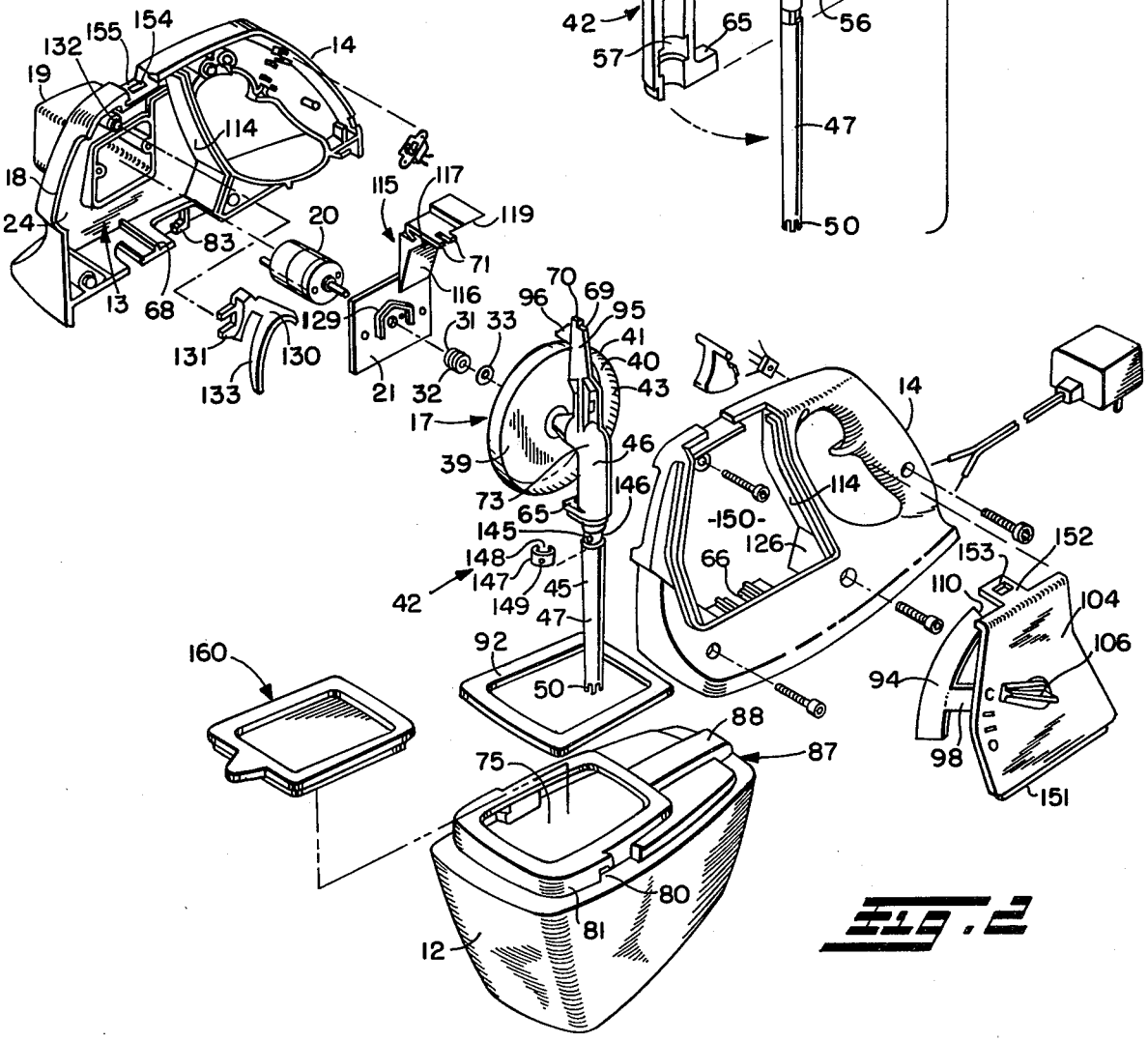
FIG. 2 is an exploded isometric view of the paint sprayer of FIG. 1.
Figure 6:
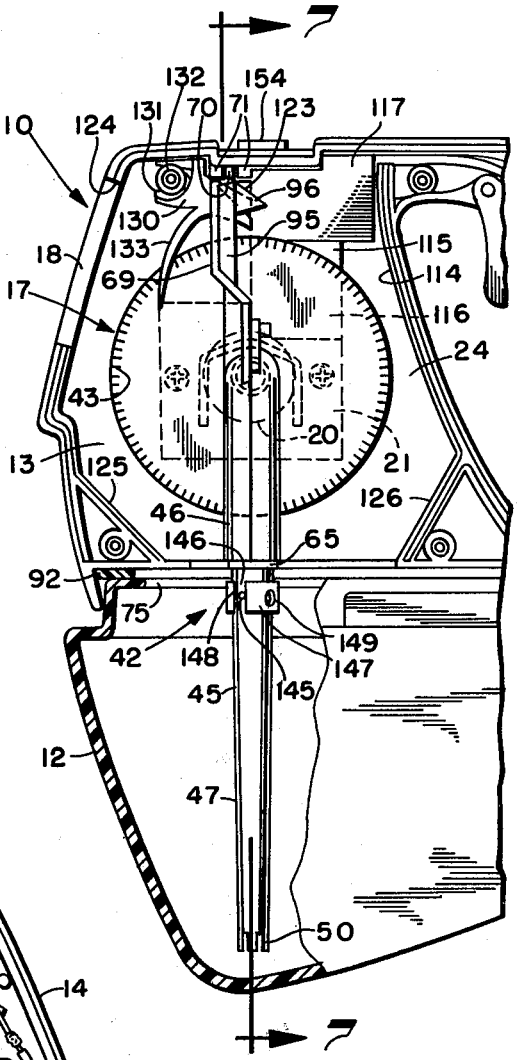
FIG. 6 is a fragmentary side elevation view of the paint sprayer also with the nearest side of the sprayer housing removed and the reservoir partly in section to better show the pump and spinner disc.
Figure 5:
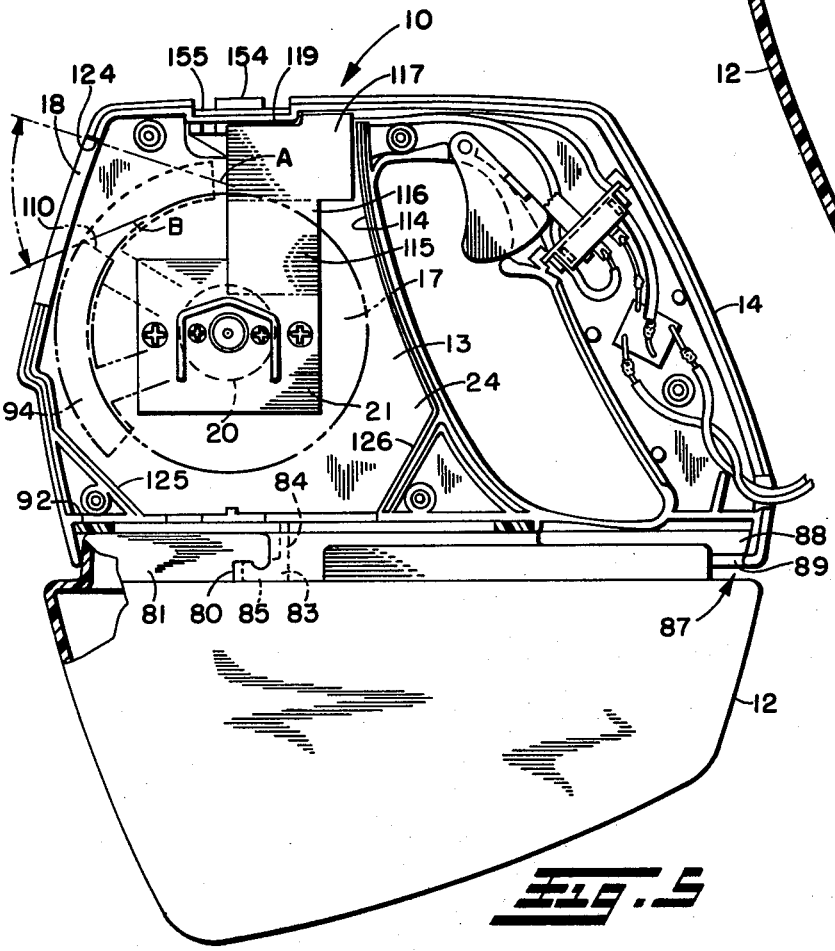
FIG. 5 is a side elevation view of the paint sprayer with the nearest side of the sprayer housing removed, showing the spinner disc and shutter in phantom, and the paint reservoir partially broken away.

As clearly shown in FIGS. 2, 5 and 6, the sprayer housing 11 contains a spray chamber 13 forward of the gripping handle 14. Within the spray chamber 13 is a vertically oriented spinner disc 17 which generates a spray by centrifugally impelling liquid paint from its surface in known manner. The spray thus generated exits from the spray chamber 13 through a vertically oriented spray discharge slot 18.

Figure 8:
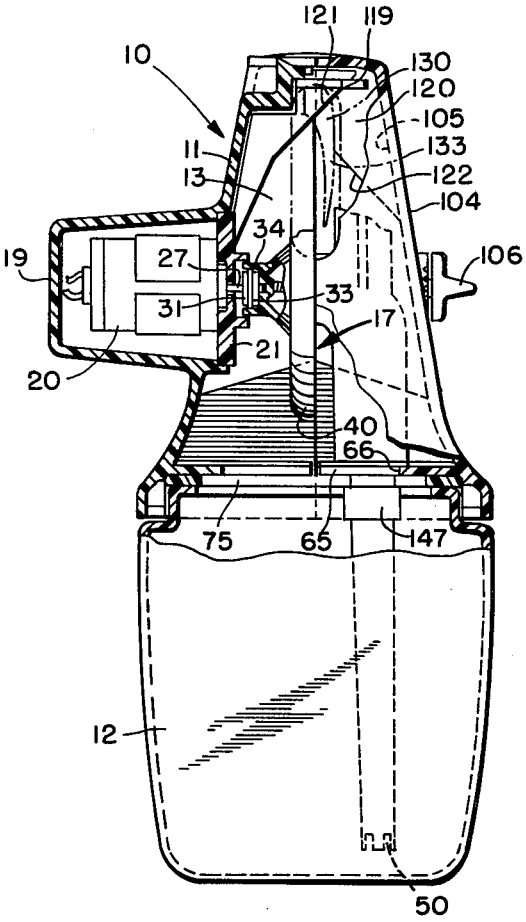
FIG. 8 is a front elevation view showing the sprayer housing and reservoir in partial section, with portions of the spinner disc and pump being omitted to better show other parts within the spayer chamber.

Projecting from one side of the sprayer housing 11 is a motor housing 19 in which an electric motor 20 is mounted upon a motor mounting plate 21. The motor mounting plate 21 covers an opening in the side wall 24 of the spray chamber 13 leading to the motor housing 19. The motor drive shaft 27 extends from the motor 20 through a drive shaft hole in the mounting plate 21 and into the spray chamber 13. As best seen in FIGS. 2 and 8, the spinner disc 17 may be removably mounted on the drive shaft 27 as by providing a drive spool 31 thereon having an annular groove 32 in which is received a compressible ring 33 having a high coefficient of friction. The ring 33, having a slightly larger O.D. than the drive spool 31, provides an effective drive connection with the spinner disc 17 which has a drive boss or hub 34 with an I.D. slightly greater than the O.D. of the drive spool 31 but less than the O.D. of the ring 33 as shown in FIG. 8. The spinner disc 17 is mounted on the drive shaft by forcibly pushing the hub onto the ring. In this position, the high frictional forces between the ring and hub provide an effective drive connection therebetween, while yet permitting ready removal of the spinner disc from the drive shaft by a simple pulling force for cleaning and the like.

Figure 9:
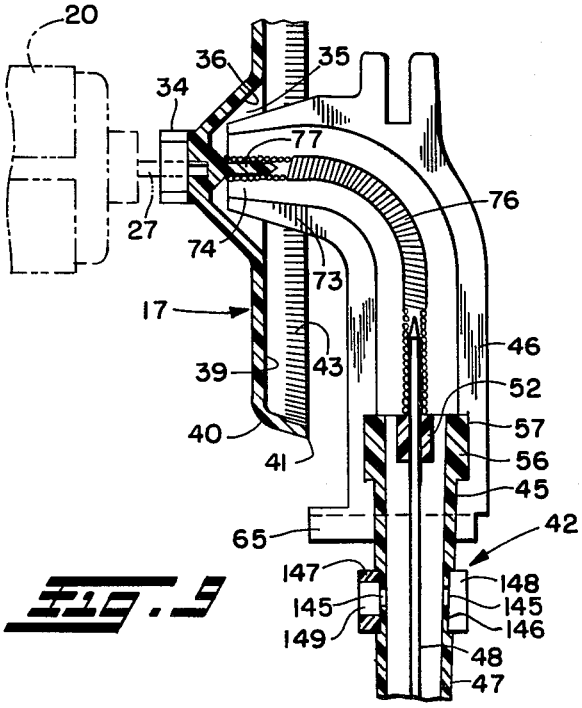
FIG. 9 is an enlarged fragmentary sectional view of the upper portion of the pump tube and spinner disc, with the motor being shown in phantom.

With particlular reference to FIG. 9, the front face of the spinner disc 17 is shown as having a central recess or well 35 including generally conical sides 36, and surrounded by a relatively large radially outwardly extending relatively large and flat or planar annular area 39 which in turn is bordered by an outer peripheral lip 40 which terminates in a feathered edge 41. A plurality of circumferentially spaced fine radial grooves 43 are also desirably provided in the feathered edge 41 of the spinner disc 17 to reduce the size of the released droplets, thereby producing finer atomization of the paint particles.

A pump 42 is provided for conveying the paint or other liquid stored within the reservoir 12 up into the spray chamber 13 in a manner to be more fully described hereafter. As shown, the pump 42 includes a pump tube 45 having an upper pump housing 46 and lower pump tube portion 47. A pump shaft 48 is coaxially disposed within the pump tube and has a screw conveyor 49 adjacent the lower end thereof. The outer peripheral surface of the screw conveyor is adjacent to the inner surface of the lower end of the lower pump tube portion 47, so that when the pump shaft is rotated in the right direction, the screw conveyor will lift the paint up through the pump tube. A plurality of circumferentially spaced vertically extending slots 50, each about ¼ inch long, are desirably provided in the bottom of the tube. Air bubbles in the paint tend to collect into one large bubble at the bottom of the tube, and the slots 50 tend to inhibit their formation. However, if a bubble should form, the paint will still usually flow around the bubble into the tube through the slots.

Figure 3:
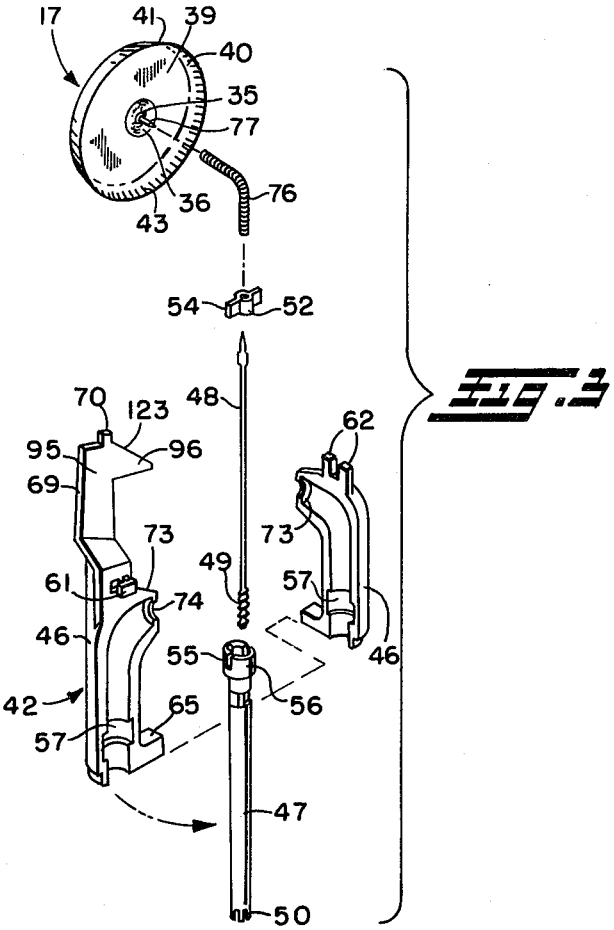
FIG. 3 is an enlarged exploded perspective view of the spinner disc, transmission shaft, and pump for the paint sprayer, with the left half of the upper pump housing shown rotated clockwise 90°.

As shown in FIGS. 3 and 9, the upper end of the shaft 48 is retained in coaxially centered relation within the lower pump tube portion 47 by means of a nylon bushing 52 on the upper end of the shaft 48. The bushing 52 has two diametric arms 54 projecting radially therefrom into two diametrically opposed slots 55 in the upper end 56 of the lower pump tube portion 47.

The upper pump housing 46 may consist of two halves joined together at a vertical, planar interface. The upper end 56 of the lower pump tube portion 47 is of a larger diameter than the remainder of the lower pump tube portion and fits within an internal groove 57 in the lower portion of the upper pump housing 46. The two halves of the upper pump housing 46 may be locked together at their upper ends as by means of a T-lock which as best seen in FIG. 3 consists of a T-shaped projection 61 on one of the halves adapted to be received between two projecting fingers 62 on the other half upon sliding the two parts together. When the upper pump housing 46 is thus assembled, the upper end 56 of the lower pump tube 47 is firmly secured within the groove 57 in the upper pump housing, and prevents the housing halves from sliding apart.

To ensure that there is no restriction to the upward movement of paint within the pump tube 45, the lower pump tube portion 47 preferably tapers outwardly toward the upper end thereof to provide a substantially unobstructed flow path for the paint passing therethrough. Also, the upper pump housing 46 may have a flow path therethrough substantially corresponding to the I.D. of the upper end of the lower pump tube portion 47.

The upper pump housing 46 may be supported at its lower end within the spray chamber 13 as by providing a mounting flange 65 on the lower end thereof which overlies the edge of a notch 66 in a flange wall 67 adjacent the bottom of the spray chamber. Directly opposite the notch is an opposing support finger 68 which engages one edge of the pump mounting flange 65 to retain the flange within the notch. The upper end of the upper pump housing 46 has an extension 69 thereon with a stud 70 projecting upwardly therefrom which is received between a pair of receiving fingers 71 on the upper wall of the spayer housing.

The upper pump housing 46 includes a horizontal portion 73 terminating in a delivery orifice 74, best seen in FIG. 9. When the pump is properly positioned within the spray chamber, the delivery orifice extends partially into the central well 35 of the spinner disc 17 as shown in FIG. 9. It is important that the orifice 74 be spaced far enough from the bottom of the well 35 so as not to restrict paint flow from the orifice into the well, and yet the orifice must be within the well cavity to ensure that all of the paint that exits through the delivery orifice will be delivered to the well.

Figure 7:
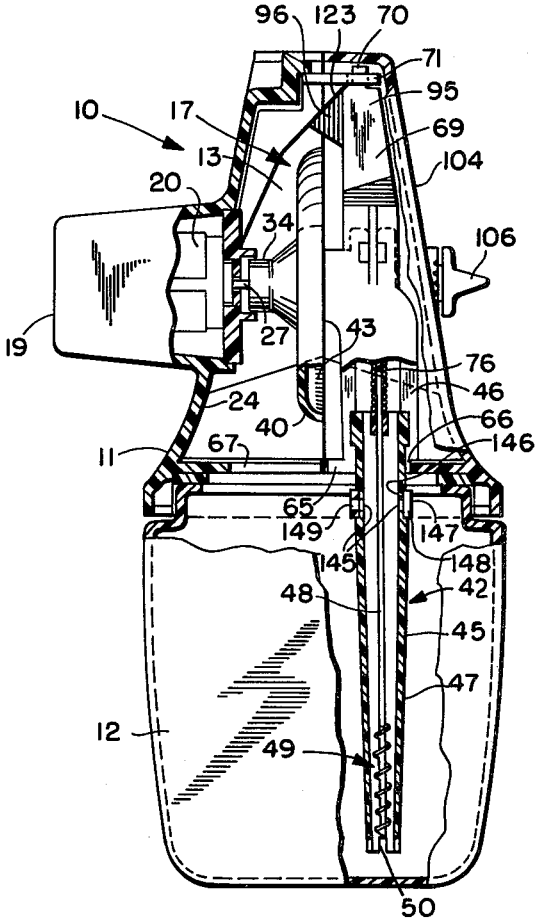
FIG. 7 is a partial vertical section through the paint sprayer taken on the plane of the line 7—7 of FIG. 6, showing the sprayer housing, reservoir, pump and spinner disc in partial section.

With the paint reservoir 12 attached to the sprayer housing 11 as shown, the lower pump tube portion 47 extends downwardly into the reservoir through a large rectangular top opening 75 therein located directly below the spray chamber 13. The bottom of the lower pump tube portion 47 and conveyor screw 49 therein extend to a depth a short distance from the bottom of the reservoir (see FIGS. 6 and 7).

Preferably, the conveyor screw 49 is driven by the same electric motor 20 which is also used to rotate the spinner disc 17. The drive connection between the motor 20 and pump shaft 48 is made through a flexible torsion-resistant transmission shaft 76 which, as shown in FIG. 9, may be a tightly wound coil attached at one end to an axial projection 77 from the spinner disc 17 and extending through the delivery orifice 74 with the other end attached to the upper end of the pump shaft 48. The transmission shaft 76, being flexible, assumes the shape of the flow path through the upper pump housing 46.

When the electric motor 20 is activated to cause the spinner disc 17 to rotate, the angular velocity of the disc is transmitted through the transmission shaft 76 to the pump shaft 48 to rotate the screw conveyor 49 in a direction to cause the screw conveyor to lift the paint or other liquid in which it is immersed.

The reservoir 12 may be releasably attached to the bottom of the sprayer housing 2 as by means of a bayonet socket which includes two generally L-shaped notches 80 on opposite sides of the upper throat portion 81 of the container which encircles the opening therein. Depending downwardly from opposite sides of the sprayer housing 11 are two similarly shaped flanges 83 each including a vertical portion 84 of substantially the same height as the notches 80 and a horizontal portion 85 having a length somewhat less than the width of the vertical portion of the notches so that when the notches and flanges are brought into alignment with each other, the notches will receive the flanges. When the bottom of the flanges engage the bottom of the notches, movement of the container 12 rearwardly relative to the sprayer housing 2 will cause the flanges to move forwardly within the notches to provide overlapping engagement between the horizontal portions of the flanges and notches which are shaped to provide some frictional or camming resistance to movement therebetween so as to avoid accidental removal or dropping off of the container.

As seen in FIG. 5, additional support for the container may be provided at the rearward end 87 thereof which has a generally T-shaped projection 88 on its upper surface that engages a notched horizontal flange 89 on the bottom rear of the sprayer housing 11 when the flanges 83 are at the bottom of the notches 80 and the container is moved rearwardly relative to the sprayer housing to lock the two parts together. A gasket 92 may be provided between the container throat 81 and the bottom of the sprayer housing 11.

The paint sprayer 10 has a number of surfaces and baffles for intercepting and removing the excess liquid spray within the spray chamber and aiding in returning the intercepted liquid to the paint reservoir 12. Moreover, the spray dispersion pattern exiting from the spray discharge slot 18 is shaped not only by the shape of the spray discharge slot itself, but also by a movable shutter 94 between the spray discharge slot and spinner disc 17; also by a side baffle 95 projecting vertically upward from the upper pump housing 46 and a top baffle 96 at the upper end of the side baffle 95. The spray discharge slot 18 is a substantially vertical slot in the upper front wall of the spray chamber and provides an outlet from the spray chamber to the exterior environment.

As best seen in FIGS. 2, 3, 6 and 7, the side baffle 95 may be an integral part of the extension 69 from the upper pump housing 46 to the top of the spray housing 11, and extends substantially vertically within the spray chamber 13 with its inner edge spaced a short distance from the outer periphery of the spinner disc 17. The side baffle 95 is also disposed at an angle somewhat greater than 90° relative to the spinner disc extending slightly toward the front of the spray chamber, so that spray striking its rearwardly facing surface will be deflected away from the spinner disc.

The top baffle 96 may also be an integral part of the upper pump housing extension 69, located at the upper end of the side baffle 95 and extending transversely within the spray chamber with the lower edge thereof projecting substantially horizontally over the vertical upper edge of the spinner disc 17. The top baffle 96 desirably extends at a slightly greater angle relative to the spinner disc than the side baffle 95 toward the rear of the spray chamber, and both the side baffle and top baffle have substantially planar surfaces.

Figure 4:
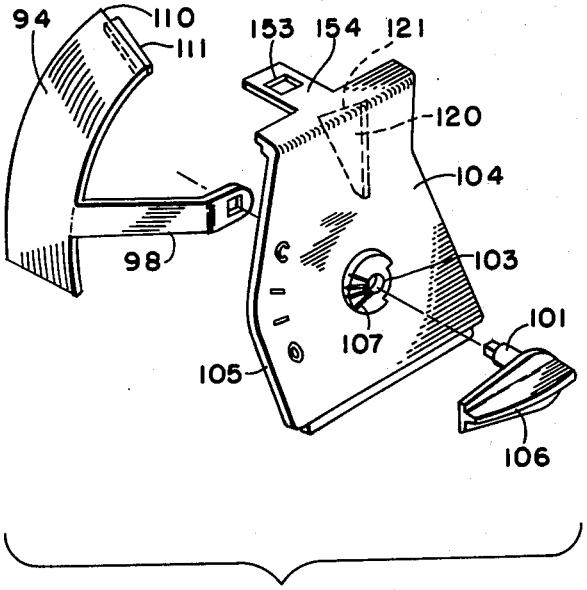
FIG. 4 is an enlarged exploded perspective view of the pump access cover, shutter and positioning knobs.

The shutter 94 is perhaps best seen in FIG. 4, and comprises an elongate arcuate plate supported at one end by a shutter arm 98 for pivotal movement about a shaft 101 rotatably mounted within a boss 103 in a pump access cover 104 which defines one of the side walls 105 of the spray chamber 13. The shutter 94 is angularly mounted upon the shutter arm 98 so that the concave surface of the shutter faces slightly away from the spinner disc 17 extending at a slight angle from front to rear toward the opposite side wall 24 of the spray chamber 13 for ease of removal of the access cover 104 without damaging the shutter. The spray being emitted from the spinner disc 17 which strikes the concave surface of the shutter will be deflected toward such opposite side wall. The shaft 101 extends through the cover 104 and has a control knob 106 mounted thereon by which the shutter 94 may be selectively rotated to any one of several positions as described hereafter. To hold the shutter in a selected position, a series of radiating grooves 107 may be provided in the boss 103 engageable by a projection or rib on the inside surface of the knob 106.

The shutter 94 is shown in FIG. 5 in two different positions, a lower position shown in dashed lines, and an upper position shown in shorter dashed lines. When the shutter is in the lowermost position, only spray leaving the feathered edge 41 of the spinner disc 17 between points A and B will exit from the spray chamber 13 through the spray discharge slot 18. The upper edge 110 of the shutter 94 intercepts all spray below the tangential point B which otherwise might have exited through the spray discharge slot. A bar-shape trim baffle 111 on the upper end of the shutter intercepts the spray and deflects it downward.

From the foregoing, it will be apparent that the lower extent of the spray dispersion pattern can be varied simply by varying the position of the shutter. Also, the amount of spray exiting from the discharge slot can be varied by varying the position of the shutter, from the maximum amount of spray when the shutter is in its lowermost position, to the complete elimination of the spray when the shutter is in its uppermost position completely closing off the discharge slot though the disc is rotating and the pump is operating.

The upper edge 124 of the spray discharge slot 18 in cooperation with the top baffle 96 determines the upper extent of the spray dispersion pattern except when the shutter completely closes off the discharge slot as previously described. Spray striking the top baffle 96 is deflected toward the front side wall 105 of the spray chamber 13 where it runs down the wall and back into the paint reservoir through the bottom of the spray chamber and reservoir opening 75.

The two vertical edges of the spray discharge slot 18 cooperate with the side baffle 95 in defining the side limits of the paint dispersion pattern. Paint striking the side baffle 95 is deflected toward the front side wall 105 where it is directed down the wall and back into the reservoir 12. Paint striking the surfaces of the spray chamber walls surrounding the spray discharge slot opening likewise runs down the walls of the spray chamber and back into the reservoir 12.

It is also desirable to intercept spray discharged from the spinner disc 17 to the rear of tangential point A to prevent an excess of spray from filling the spray chamber 13 and drifting in front of the spray directed toward the spray discharge slot 18 which might cause the formation of larger droplets of paint spray and cause the paint striking the surface to be painted to run and streak. Likewise, it is desirable to prevent excess paint from dripping from the upper portion of the spray chamber onto the spinner disc 17 because of the adverse effect it may have on the spray dispersion pattern.

Projecting from the upper surface of the back half of the motor mounting plate 21 is a deflector wall 115 rising vertically and sloping away from the back side wall 24 toward the interior of the spray chamber. The deflector wall 115 has a lower portion 116 and upper portion 117 both of which have planar surfaces facing the back side of the spinner disc. The upper portion 117 slopes away from the back side wall 24 at a greater angle than the lower portion 116 and extends over the back half of the vertically upper edge of the spinner disc so that the plane formed by the feathered edge 41 of the spinner disc 17 intersects the surface 117 on a fairly steep slope to facilitate fast run-off of the excess paint that strikes such surface. The upper edge 119 of such upper portion terminates near the top edge of the front side wall 105 of the spray chamber 13 as far toward the front side wall 105 as possible.

Projecting from the front side wall 105 is an additional side baffle 120 which has a vertical planar surface substantially perpendicular to the spinner disc. The side baffle 120 is positioned between the side baffle 95 and rear wall 114 of the spray chamber. The upper edge 121 of the side baffle 120 is downwardly angled so that it is substantially flush against the surface of the upper portion 117 of the deflector wall 115, whereas the lower edge 122 of the baffle 120 extends beyond the back upper edge of the spinner disc 17. The top edge 123 of the top baffle 96 is also downwardly angled and abuts flush with the surface of the upper deflector wall portion 117.

The upper portion 117 of the deflector wall 115 causes spray striking it to run down its sloping surface to the lower portion 116 of the deflector wall, and then down the back side wall 24 of the spray chamber into the reservoir 12 rather than dripping back down onto the spinner disc where it would disrupt optimum spray droplet formation. Any excess paint which is blown forward along the upper portion 117 of the deflector wall 115 due to the wind effect of the spinning disc will be picked up by a front trimmer plate 130 which, as best seen in FIGS. 2, 6 and 8, slopes toward the spray discharge slot 18 from the back side wall 24 of the spray chamber 13 to the front side wall 105 across the spinner disc. The trimmer 130 desirably has a notched flange 131 to provide a snap attachment on a boss 132 on the back side wall 24, and is shaped in such a manner that it will conduct the excess paint which is blown forward along the deflector surface 117 across the spinner disc and down the pointed from edge 133 of the trimmer adjacent the access cover 105, from which such excess paint drips back into the paint reservoir. Liquid running down the walls of the spray chamber is also aided in its return to the reservoir 12 by front 125 and back 126 sloping walls adjacent the forward and rear ends of the spray chamber 13.

A downwardly opening U-shaped baffle 129 projects from the mounting plate 21 and extends over and around the portion of the drive shaft 27 between the mounting plate and drive hub 31 to prevent excess paint from getting on the drive shaft and in the drive shaft hole.

Provision is also desirably made for varying the amount of paint that is delivered to the spinner disc by the pump without varying the speed of rotation of the spinner disc and thus the output of the pump driven thereby. This is particularly important in order to permit the use of a high speed pump of the type shown, which is directly coupled to the spinner disc, to reach a more stable high flow condition without transporting all of the paint flow to the disc. It is the quantity of paint that is discharged onto the disc that draws power, and if too much paint is discharged, the load on the motor causes the disc to slow down, producing poor paint atomization. The pump itself draws relatively little power, and it has been found that the pump performance will be more consistent between paints if some of the paint is recirculated without being discharged onto the disc. This is particularly important in order to maintain good paint atomization over a wide range of paint viscosities being pumped. If the volume of the higher viscosity liquids being pumped onto the disc is not reduced, the thicker liquid material may be spun off in large droplets, which is undesirable. Recirculating a portion of the liquid without discharging same onto the spinner disc prevents this.

In the preferred embodiment shown in the present application, a portion of the liquid may be recirculated without being discharged onto the spinner disc as by providing one or more circumferentially spaced holes in the lower pump tube portion 47 above the paint lifting screw 49 which may be selectively uncovered for dumping a portion of the liquid being pumped directly back to the reservoir. As best seen in FIGS. 2, 6, 7 and 9, the lower pump tube portion 47 may be provided with two diametrically opposed liquid diversion openings 145 in the upper portion thereof above the screw conveyor. A wide annular groove 146 in the exterior of the lower pump tube portion 47 intersects the liquid diversion openings 145 therein and there is a C-shaped ring 147 within the annular groove.

The C-shaped ring 147 is made of a suitable flexible material such as plastic, and has a radius somewhat less than that of the groove 146 and an arcuate length greater than 180°. Accordingly, the ring can be spread apart and snapped into the groove providing a relatively snug fit therewith while still permitting relative rotation of the ring within the groove.

The ends of the ring have a gap 148 therebetween, and there is an opening 149 through the ring diametrically opposite the gap, whereby the ring may be rotatably positioned in the groove to cover none, one or both of the liquid diversion openings 145 at a time. The gap in the ring is relatively large, allowing the smaller opening 149 in the ring to be moved out of alignment with one of the liquid diversion openings 145 while the other diversion opening is still within the region encompassed by the gap as shown in FIG. 6, in which event only one of the diversion openings will be covered. Some of the liquid being pumped through the pump tube 45 thus may be diverted through the diversion openings 145 instead of being conveyed to the spinner disc 17.

Most of the parts of the paint sprayer 10, with few exceptions, may be made from suitable plastics materials. Also, the paint sprayer is designed for maximum accessibility and ease of cleaning.

Ready access may be had to the spray chamber through the access cover 104 which is simply snap-locked in place. The access cover overlies a pump access opening 150 leading into the spray chamber 13, and has an inset flange 151 on the bottom edge thereof for engagement with and support by the lower edge of the pump access opening. The top of the pump access cover has a horizontally extending strap 152 with a rectangular hole 153 in its outer end for snap-lock engagement with a lug 154 projecting upwardly from an indentation 155 in the top of the sprayer housing which snugly receives the strap.

When the paint sprayer is not in use, the reservoir 12 may also readily be removed from the sprayer housing and cleaned out. Also, if desired, a cover 160, shown in FIG. 2, may be provided for the reservoir when removed from the sprayer housing. Moreover, all of the pump parts and the spinner disc may readily be removed from the spray chamber and dismantled to facilitate cleaning of all of the sprayer parts, including the interior of the spray chamber as well as the spinner disc and pump parts.

Although the invention has been shown and described with respect to a preferred embodiment, it will be obvious that equivalent alterations and modifications will occur to other skilled in the art upon reading and understanding of the specification. The present invention includes all such equivalent alterations and modifications and is limited only by the scope of the claims.

The embodiments of the invention in which an exclusive property or privilege is claimed are defined as follows:

1. A portable pump spraying device comprising a container for the liquid to be sprayed, a sprayer housing connected to said container, said housing containing a spray chamber having a vertically oriented spray discharge slot, a vertically oriented spinner disc in said spray chamber, pump means for pumping the liquid to be sprayed from said container onto said spinner disc, said pump means including a lower generally vertical pump tube portion extending into said container, a conveyor screw coaxially and rotatably disposed within said lower pump tube portion, and an upper pump tube portion having a right angle bend extending generally perpendicular to the spinner disc axis, drive means for rotating said spinner disc, and a flexible torsion-resistant transmission shaft drivingly axially connecting said spinner disc and said conveyor screw through said upper and lower pump tube portions, said upper pump tube portion having a delivery orifice opening toward the face of said spinner disc for delivering the pumped liquid onto said spinner disc, the rotation of said spinner disc being operative by centrifugal force to form a spray from the liquid delivered thereto and impel a portion of the spray through said spray discharge slot.

2. The pump spraying device of claim 1 wherein said transmission shaft is a tightly wound coil.

3. The pump spraying device of claim 1 wherein there is a vertical projection on said upper tube portion, said vertical projection including a side baffle facing away both from said spray discharge slot and said face of said spinner disc, for intercepting excess liquid from the spray, aiding in defining a pattern of spray dispersion, and assisting in returning excess liquid to said container for recirculation by said pump means.

4. The pump spraying device of claim 3 wherein said vertical projection has at its upper end a top baffle extending over the upper edge of said spinner disc, said top baffle facing away from both said spray discharge slot and said face of said spinner disc.

5. The pump spraying device of claim 1 further comprising a front trimmer extending over the upper edge of said spinner disc, said front trimmer sloping toward said spray discharge slot from one side of said spray chamber to the other across said spinner disc.

6. The pump spraying device of claim 5 wherein said front trimmer has a downwardly extending portion adjacent the other side of said spray chamber, said front trimmer being operative to direct excess liquid which is blown forward along one side of said spray chamber by said spinner disc across said spinner disc and down along said downwardly extending portion for return to said container.

7. The pump spraying device of claim 1 wherein said lower pump tube portion has at its lower end a liquid intake opening for drawing liquid into said lower pump tube portion, said lower pump tube portion also having in its side wall, between said liquid intake opening and said delivery orifice, a liquid diversion opening providing a flow path for diverting excess liquid being pumped directly back to said container before being discharged onto said spinner disc.

8. The pump spraying device of claim 7 further comprising closure means for selectively opening and closing said liquid diversion opening.

9. The pump spraying device of claim 8 wherein said lower pump tube portion has an annular groove in the outer surface thereof intersecting said liquid diversion opening, and said closure means comprises a C-shape ring mounted within said annular groove and rotatable therein for respectively opening and closing said liquid diversion opening.

10. The pump spraying device of claim 9 wherein there are two liquid diversion openings in said lower pump tube portion, and said ring has two circumferentially spaced openings therein which may be selectively brought into alignment with one, both, or none of said liquid diversion openings for varying the amount of liquid being pumped by said pump means onto said spinner disc.

11. The pump spraying device of claim 10 wherein one of said openings in said ring is substantially larger than the other opening.

12. The pump spraying device of claim 11 wherein said larger opening in said ring is formed by a gap between the ends of said ring.

13. The pump spraying device of claim 1 further comprising a plurality of circumferentially spaced slots in the lower end of said lower pump tube portion to inhibit the formation of large air bubbles at the bottom of said lower pump tube portion and provide additional flow paths for the liquid into said lower pump tube portion in the event that an air bubble does form thereat.

14. The pump spraying device of claim 1 wherein said drive means comprises a motor having a drive shaft, a drive wheel coaxially secured to said drive shaft, said drive wheel having a radially outermost portion with a high coefficient of friction providing a friction fit with a drive boss on said spinner disc thus forming a drive connection therebetween.

15. The pump spraying device of claim 14 wherein said drive boss is integral with said spinner disc.

16. The pump spraying device of claim 14 wherein said radially outermost portion of said drive wheel comprises a compressible ring disposed in an annular groove in said drive wheel.

17. The pump spraying device of claim 1 wherein said spinner disc has a central well on said face, said delivery orifice extending part way into said well for discharge of the liquid to be sprayed therein while being spaced from the bottom of said well so as not to restrict liquid flow from said delivery orifice into said well.

18. The pump spraying device of claim 17 wherein said face of said spinner disc has a relatively large flat annular region surrounding said well, and an outer peripheral angled flange surrounding said flat annular region.

19. The pump spraying device of claim 18 wherein said outer peripheral angled flange has a feathered edge.

20. The pump spraying device of claim 19 wherein said feathered edge has a plurality of circumferentially spaced fine radial grooves therein to reduce the size of the spray particles.

21. The pump spraying device of claim 1 wherein said spinner disc has a relatively large flat annular region and an outer peripheral angled flange surrounding said flat annular region, said outer peripheral angled flange having a feathered edge, and a plurality of circumferentially spaced final radial grooves in said feathered edge to reduce the size of the spray particles leaving said spinner disc.

22. The pump spraying device of claim 1 wherein said upper pump tube portion is formed in two halves joined together at a vertical planar interface.

23. The pump spraying device of claim 22 wherein said upper pump tube portion includes a generally right-angle bend defining a generally vertical portion connected at its lower end to the upper end of said lower pump tube portion and a generally horizontal portion which terminates in said delivery orifice a short distance from said spinner disc face.

24. The pump spraying device of claim 23 further comprising a T-lock at the upper end of said upper pump tube portion halves for slidably locking said halves together.

25. A portable pump spraying device comprising a container for the liquid to be sprayed, a sprayer housing connected to said container, said housing containing a spray chamber having a spray discharge slot, pump means for pumping liquid to said spray chamber from said container, a spinner disc in said spray chamber mounted for rotation about a generally horizontal axis, said disc having a central well, a relatively large flat intermediate portion surrounding said central well and extending radially outwardly therefrom, and an outer peripheral angled lip bordering said intermediate portion, said lip terminating in a feathered edge, drive means for rotating said disc, and delivery means for delivering the liquid to be sprayed from said container to said spray chamber for discharge into said central well, the rotation of said spinner disc being operative by centrifugal force to impel the liquid within said well from said disc as a spray.

26. The pump spraying device of claim 25 wherein said feathered edge has a plurality of circumferentially spaced fine radial grooves therein to reduce the size of the spray particles leaving said spinner disc.

27. The pump spraying device of claim 25 wherein said delivery means includes a pump tube having a right-angle bend defining a generally vertical portion extending from said spray chamber into said container and a generally horizontal portion terminating in a delivery orifice extending part way into said well for discharge of the liquid being pumped into said well.

28. A portable pump spraying device comprising a container for the liquid to be sprayed, a sprayer housing connected to said container, said housing containing a spray chamber having a substantially vertical spray discharge slot, pump means for pumping liquid to said spray chamber from said container, a vertically oriented spinner disc in said spray chamber, drive means for rotating said spinner disc within said spray chamber, delivery means for delivering the liquid pumped to said spray chamber by said pump means onto a face of said spinner disc, the rotation of said spinner disc being operative by centrifugal force to impel a portion of the liquid delivered thereto through said spray discharge slot as a spray, and interceptor means within said spray chamber to define a pattern of spray dispersion and assist in returning excess liquid to said chamber for recirculation by said pump means, said interceptor means including said spray discharge slot for limiting the horizontal and upper spray dispension, a selectively positionable shutter between said spray discharge slot and said spinner disc to define a plurality of selectable lower limits to the pattern of spray dispersion including a position for preventing any spray from exiting through said spray discharge slot, said shutter being of generally arcuate shape having a convex outer surface facing said spray discharge slot and a concave inner surface facing said spinner disc, and means mounting said shutter for limited pivotal movement between such selectable positions, said means mounting said shutter for movement comprising a rotatable shaft extending through a side wall of said sprayer housing into said spray chamber, and a shutter arm connecting said shutter to said rotatable shaft for pivotal movement therewith.

29. The pump spraying device of claim 28 wherein said pump means includes a pump tube having a generally horizontal portion terminating in a discharge orifice adjacent said spinner disc for discharging the liquid being pumped onto said spinner disc and a generally vertical portion extending from said generally horizontal portion into said container, a conveyor screw rotatably disposed within the lower end of said generally vertical portion, and drive means for drivingly axially connecting said conveyor screw to said spinner disc through approximately a right-angle bend in said pump tube for rotation thereby.

30. The pump spraying device of claim 29 wherein said drive means comprises a flexible, torsion-resistant transmission shaft extending coaxially through said pump tube and having one end connected to said spinner disc and the other end connected to said conveyor screw.

31. The pump spraying device of claim 28 wherein said pump means includes a pump tube extending from said container into said spray chamber, said pump tube having a side baffle extending upwardly therefrom within said spray chamber, said side baffle facing away from both said spray discharge slot and said spinner disc and being operative to deflect the spray striking said side baffle into a side wall of said spray chamber.

32. The pump spraying device of claim 28 wherein said spray chamber has opposite side walls generally perpendicular to the axis of said spinner disc, one of said side walls having a drive shaft projecting therefrom on which said spinner disc is mounted for rotation, said one side wall having a deflector wall thereon, said deflector wall sloping away from said one side wall with increasing height and extending over the top edge of said spinner disc to intercept upwardly directed spray, and a side wall baffle projecting normally from the other side wall, said side wall baffle sloping away from said other side wall with increasing height and extending over the top edge of said spinner disc, the upper edge of said side wall baffle abutting against an upward portion of said deflector wall.

33. The pump spraying device of claim 32 further comprising a front trimmer extending over the upper edge of said spinner disc, said front trimmer sloping toward said spray discharge slot from said one side wall of said spray chamber to said other side wall across said spinner disc.

34. The pump spraying device of claim 33 wherein said front trimmer has a downwardly extending portion adjacent said other side wall of said spray chamber, said front trimmer being operative to direct excess liquid which is blown forward along said deflector wall by said spinner disc across said spinner disc and down along said downwardly extending portion for return to said container.

35. The pump spraying device of claim 32 further comprising a downwardly opening U-shape baffle on said one side wall of said spray chamber surrounding said drive shaft to aid in preventing liquid from running onto said drive shaft.

36. The pump spraying device of claim 32 further comprising a removable pump access cover received within a pump access opening in said other side wall of said spray chamber.

37. The pump spraying device of claim 36 wherein said means mounting said shutter for movement is carried by said removable access cover, and said concave surface of said shutter presents an oblique face to said spinner disc to facilitate removal of said access cover and shutter carried thereby without damaging said shutter.

38. The pump spraying device of claim 36 wherein said pump access cover has a horizontal bottom edge including a downwardly projecting inset flange, and said pump access opening has a bottom horizontal flange which is engaged by said horizontal bottom edge of said pump access cover, and the top edge of said pump access cover has a horizontally projecting lock strap with a slot therein, said pump housing having an indentation in the top surface thereof for receipt of said strap, and a lug projecting upwardly from said indentation into said slot in said strap to secure said pump access cover in place within said pump access opening.

39. A portable pump spraying device comprising a container for the liquid to be sprayed, a sprayer housing removably connected to said container, said housing containing a spray chamber having a spray discharge slot, a spinner disc in said spray chamber, pump means for pumping liquid to said spray chamber from said container, delivery means for delivering such pumped liquid onto a face of said spinner disc, and drive means for rotating said spinner disc, said pump means including a pump tube having a generally horizontal portion terminating in a discharge orifice adjacent said spinner disc for discharging the liquid being pumped onto said spinner disc and a generally vertical portion extending from said generally horizontal portion into said container, a conveyor screw rotatably disposed within the lower end of said generally vertical portion, and drive means for drivingly axially connecting said conveyor screw to said spinner disc through approximately a right-angle bend in said pump tube for rotation thereby, said removable connection between said sprayer housing and container comprising a raised collar surrounding an opening in the top of said container communicating with a bottom opening in said sprayer housing, said collar containing a generally L-shape notch on opposite sides of said container opening, and generally L-shape flanges depending downwardly from opposite sides of the bottom of said sprayer housing for snap-lock engagement within said notches.

40. The pump spraying device of claim 39 further comprising a T-lock projecting from one end of said container for engagement within a notched flange projecting inwardly from an end of said sprayer housing.

41. A portable pump spraying device comprising a container for the liquid to be sprayed, a sprayer housing connected to said container, said housing containing a spray chamber having a substantially vertical spray discharge slot, pump means for pumping liquid to said spray chamber from said container, a vertically oriented spinner disc in said spray chamber, and drive means for rotating said spinner disc with said spray chamber, delivery means for delivering the liquid pumped to said spray chamber by said pump means onto a face of said spinner disc, the rotation of said spinner disc being operative by centrifugal force to impel a portion of the liquid delivered thereto through said spray discharge slot as a spray, said pump means including a pump tube having a generally horizontal portion terminating in a discharge orifice adjacent said spinner disc for discharging the liquid being pumped onto said spinner disc and a generally vertical portion extending from said generally horizontal portion into said container, a conveyor screw rotatably disposed within the lower end of said generally vertical portion, and drive means for drivingly axially connecting said conveyor screw to said spinner disc through approximately a right-angle bend in said pump tube for rotation thereby.

42. The pump spraying device of claim 41 wherein said drive means comprises a flexible, torsion-resistant transmission shaft extending coaxially through said pump tube and having one end connected to said spinner disc and the other end connected to said conveyor screw.

43. The pump spraying device of claim 41 further comprising a plurality of circumferentially spaced slots in the lower end of said generally vertical pump tube portion to inhibit the formation of large air bubbles at the bottom of said generally vertical pump tube portion and provide additional flow paths for the liquid into said generally vertical pump tube portion in the event that an air bubble does form thereat.

44. A portable pump spraying device comprising a container for the liquid to be sprayed, a sprayer housing connected to said container, said housing containing a spray chamber having a substantially vertical spray discharge slot, pump means for pumping liquid to said spray chamber from said container, a vertically oriented spinner disc in said spray chamber, and drive means for rotating said spinner disc within said spray chamber, delivery means for delivering the liquid pumped to said spray chamber by said pump means onto a face of said spinner disc, the rotation of said spinner disc being operative by centrifugal force to impel a portion of the liquid delivered thereto through said spray discharge slot as a spray, said pump means including a pump tube extending from said container into said spray chamber, said pump tube having a side baffle extending upwardly therefrom within said spray chamber, said side baffle facing away from both said spray discharge slot and said spinner disc and being operative to deflect the spray striking said side baffle into a side wall of said spray chamber.

45. The pump spraying device of claim 44 further comprising a removable connection between said sprayer housing and container, said removable connection comprising a raised collar surrounding an opening in the top of said container communicating with a bottom opening in said sprayer housing, said collar containing a generally L-shape notch on opposite sides of said container opening, and generally L-shape flanges depending downwardly from opposite sides of the bottom of said sprayer housing for snap-lock engagement within said notches.

46. The pump spraying device of claim 44 wherein said pump tube includes an upper tube portion having a vertical projection thereon, said vertical projection including said side baffle.

47. The pump spraying device of claim 46 wherein said vertical projection has at its upper end a top baffle extending over the upper edge of said spinner disc, said top baffle facing away from both said spray discharge slot and said spinner disc.

48. A portable pump spraying device comprising a container for the liquid to be sprayed, a sprayer housing connected to said container, said housing containing a spray chamber having a substantially vertical spray discharge slot, pump means for pumping liquid to said spray chamber from said container, a vertically oriented spinner disc in said spray chamber, and drive means for rotating said spinner disc within said spray chamber, delivery means for delivering the liquid pumped to said spray chamber by said pump means onto a face of said spinner disc, the rotation of said spinner disc being operative by centrifugal force to impel a portion of the liquid delivered thereto through said spray discharge slot as a spray, said spray chamber having opposite side walls generally perpendicular to the axis of said spinner disc, one of said side walls having a drive shaft projecting therefrom on which said spinner disc is mounted for rotation, said one side wall having a deflector wall thereon, said deflector wall sloping away from said one side wall with increasing height and extending over the top edge of said spinner disc to intercept upwardly directed spray, and a side wall baffle projecting normally from the other side wall, said side wall baffle sloping away from said other side wall with increasing height and extending over the top edge of said spinner disc, the upper edge of said side wall baffle abutting against an upward portion of said deflector wall.

49. The pump spraying device of claim 48 further comprising a front trimmer extending over the upper edge of said spinner disc, said front trimmer sloping toward said spray discharge slot from said one side wall of said spray chamber to said other side wall across said spinner disc.

50. The pump spraying device of claim 49 wherein said front trimmer has a downwardly extending portion adjacent said other side wall of said spray chamber, said front trimmer being operative to direct excess liquid which is blown forward along said deflector wall by said spinner disc across said spinner disc and down along said downwardly extending portion for return to said container.

51. The pump spraying device of claim 50 further comprising a downwardly opening U-shape baffle on said one side wall of said spray chamber surrounding said drive shaft to aid in preventing liquid from running onto said drive shaft.

52. The pump spraying device of claim 48 further comprising a removable pump access cover received within a pump access opening in said other side wall of said spray chamber.

53. The pump spraying device of claim 52 further comprising a selectably positionable shutter between said spray discharge slot and said spinner disc to define a plurality of selectable lower limits to the pattern of spray dispersion including a position for preventing any spray from exiting through said spray discharge slot, said shutter being of generally arcuate shape having a convex outer surface facing said spray discharge slot and a concave inner surface facing said spinner disc, and means mounting said shutter for limited pivotal movement between such selectable positions, said means mounting said shutter for movement being carried by said removable access cover, and said concave surface of said shutter presenting an oblique face to said spinner disc to facilitate removal of said access cover and shutter carried thereby without damaging said shutter.

54. The pump spraying device of claim 52 wherein said pump access cover has a horizontal bottom edge including a downwardly projecting inset flange, and said pump access opening has a bottom horizontal flange which is engaged by said horizontal bottom edge of said pump access cover, and the top edge of said pump access cover has a horizontally projecting lock strap with a slot therein, said pump housing having an indentation in the top surface thereof for receipt of said strap, and a lug projecting upwardly from said indentation into said slot in said strap to secure said pump access cover in place within said pump access opening.

55. The pump spraying device of claim 48 further comprising a removable connection between said sprayer housing and container, said removable connection comprising a raised collar surrounding an opening in the top of said container communicating with a bottom opening in said sprayer housing, said collar containing a generally L-shape notch on opposite sides of said container opening, and generally L-shape flanges depending downwardly from opposite sides of the bottom of said sprayer housing for snap-lock engagement within said notches.

56. A portable pump spraying device comprising a container for the liquid to be sprayed, a sprayer housing connected to said container, said housing containing a spray chamber having a substantially vertical spray discharge slot, pump means for pumping liquid to said spray chamber from said container, a vertically oriented spinner disc in said spray chamber, and drive means for rotating said spinner disc within said spray chamber, delivery means for delivering the liquid pumped to said spray chamber by said pump means onto a face of said spinner disc, the rotation of said spinner disc being operative by centrifugal force to impel a portion of the liquid delivered thereto through said spray discharge slot as a spray, said pump means including a lower pump tube portion having at its lower end a liquid intake opening for drawing liquid into said lower pump tube portion, said lower pump tube portion also having in its side wall, between said liquid intake opening and said spray chamber, a liquid diversion opening providing a flow path for diverting a portion of the liquid being pumped directly back to said container while at the same time the remainder of the liquid being pumped is discharged onto said spinner disc, said liquid diversion opening thus reducing the amount of liquid which is discharged onto said spinner disc by said pump means.

57. The pump spraying device of claim 56 further comprising closure means for selectively opening and closing said liquid diversion opening.

58. The pump spraying device of claim 57 wherein said lower pump tube portion has an annular groove in the outer surface thereof intersecting said liquid diversion opening, and said closure means comprises a C-shape ring mounted within said annular groove and rotatable therein for respectively opening and closing said liquid diversion opening.

59. The pump spraying device of claim 58 wherein there are two liquid diversion openings in said lower pump tube portion, and said ring has two circumferentially spaced openings therein which may be selectively brought into alignment with one, both, or none of said liquid diversion openings for varying the amount of liquid being pumped by said pump means onto said spinner disc.

60. The pump spraying device of claim 59 wherein one of said openings in said ring is substantially larger than the other opening.

* * * * *